United States Patent [19]

Shiozaki

[11] 3,955,249

[45] May 11, 1976

[54] CLAMPING DEVICE

[76] Inventor: Hiromitsu Shiozaki, 93, Aza Yashiki, Tosakicho, Okazaki, Aichi, Japan

[22] Filed: July 2, 1974

[21] Appl. No.: 485,280

[30] Foreign Application Priority Data

July 5, 1973 Japan ..... 48-76371

[52] U.S. Cl. ..... 24/251; 72/705

[51] Int. Cl.[2] ..... B21D 11/02; A44B 21/00

[58] Field of Search ..... 24/242, 232, 251, 243 AB, 24/243 HS, 243 FS, 248 C, 248 BC, 248 FS, 249 WL; 254/19; 72/295, 296, 305, 705

[56] References Cited

UNITED STATES PATENTS

| | | | |
|---|---|---|---|
| 295,824 | 3/1884 | Skinner | 24/251 |
| 641,265 | 1/1900 | Brassington | 24/242 |
| 1,025,058 | 4/1912 | Hampson | 24/243 FS X |
| 1,248,596 | 12/1917 | Bailey | 24/242 |
| 2,979,102 | 4/1961 | Ferguson et al. | 72/705 |
| 3,169,010 | 2/1965 | Crawford | 254/19 |
| 3,452,575 | 7/1969 | Williams et al. | 72/705 |
| 3,526,120 | 9/1970 | Hunnicutt et al. | 72/705 X |
| 3,570,289 | 3/1971 | Smyers | 72/705 X |
| 3,744,838 | 7/1973 | Jackson | 72/705 X |

FOREIGN PATENTS OR APPLICATIONS

| | | | |
|---|---|---|---|
| 1,223,498 | 2/1960 | France | 24/248 FS |
| 681,694 | 9/1939 | Germany | 72/295 |

*Primary Examiner*—Donald A. Griffin
*Attorney, Agent, or Firm*—Cushman, Darby & Cushman

[57] ABSTRACT

A clamping device especially adapted for use with an automotive body or frame straightening device is disclosed wherein at least two clamping members each having a clamping jaw section at one end thereof and a clamping guide section at the other end thereof are held together by a retaining ring in such a manner that they may pivot about a ball disposed inwardly thereof, and within the space defined by the clamping guide sections is disposed a tapered member which has an outwardly tapered outer peripheral surface. When the tapered member is drawn or pulled outwardly, its tapered outer surface forces the clamping guide sections to move away from each other while forcing the clamping jaw sections to move toward each other, whereby the strong clamping force is produced.

10 Claims, 11 Drawing Figures

CLAMPING DEVICE

The present invention relates to a mechanical clamping device especially adapted to firmly grip a metal plate, bar or rod. The clamping device of this type is generally used to draw or lift a metal plate, bar or rod while firmly clamping it. The clamping device in accordance with the present invention is particularly adapted for use with a body or frame straightening or alignment device for straightening or aligning an automotive body including its frame, doors and so on bent or twisted by accidents.

To straighten a bent or twisted frame, a clamping device is used to clamp the bent or twisted frame, and is drawn or pulled by a hydraulic jack so as to straighten the bent or twisted frame. The clamping devices used for this purpose must be simple in both construction and operation and must firmly clamp a member even when an excessive drawing or pulling force of the order of, for instance, 10 tons is exerted thereto. Furthermore, it is essential that the clamping force be increased as the drawing or pulling force is increased.

One prior art clamping device used for this purpose comprises a pair of clamping arms or members each having a clamping jaw section at one end thereof and an inwardly bent section at the other end thereof, a clamping bolt fitted into both the pair of clamping members so as to cause them to move toward or away from each other, and a ring fitted into the space defined by the inwardly bent sections. In operation, a member to be drawn is clamped between the clamping jaws by tightening the clamping bolt, and the ring is pulled or drawn by a hydraulic jack so as to straighten or extend the clamped member. Since the ring is fitted into the space defined by the inwardly bent sections, when it is pulled, it forces the inwardly bent sections to move away from each other so that the clamping jaws may exert the stronger clamping force to the member clamped therebetween.

However, a substantial part of the clamping force is provided by tightening the clamping bolt, and the pair of clamping arms or members are held substantially in parallel with each other because the undersurface of the head of the clamping bolt is made into contact with the upper surface of one of the clamping arms or members and because the externally threaded screws of the bolt are in engagement with the internally threaded screws of the other clamping member. Therefore, when the ring is pulled outwardly to force the inwardly bent sections to move away from each other, the clamping bolt is subject to bending. Therefore, in the worst case the head of the clamping bolt is torn off suddenly and flies away at a high speed when the drawing force is increased, thus causing physical injuries to the workers. Another defect of the prior art clamping device of the type described is that the mode of operation is very complex as the clamping bolt must be tightened to clamp a frame or the like and it must be loosened to release the frame or the like. Furthermore it becomes extremely difficult, if not impossible, to release the clamped frame when the latter is torn off from the main body. Moreover the clamping force is mainly provided by tightening the clamping bolt so that the latter must be tightened very tightly to provide a sufficient clamping force. As a result, the clamping bolt and its screws tend to be easily damaged so that the service life of the prior art clamping device is very short. The clamping force is not increased in proportion to the increase in drawing or pulling force, so that there is a fear that a clamped member is pulled out of the clamping device. A still another defect of the prior art clamping device of the type described is that the axial length of the space within which the member to be clamped may be received past the clamping jaws is not sufficient because the clamping bolt is extending through the pair of clamping arms substantially at the midpoint thereof.

In view of the above one of the objects of the present invention is to provide a clamping device which may substantially overcome the above and other defects or problems encountered in the prior art clamping devices, is simple both in construction and in operation, is capable of firmly gripping a member even an extensive drawing or pulling force of the order of, for instance, 10 tons is exerted and may increase its clamping force as the drawing or pulling force is increased.

According to the present invention, there is provided a clamping device comprising at least two clamping members each having a clamping jaw section at one end thereof and a clamping guide section at the other end thereof; and inner fulcrum member supporting each of said at least two clamping members from the inside thereof so as to enable said clamping members to pivot about said inner fulcrum member, said inner fulcrum member being positioned between both ends of each of said clamping members; an outer fulcrum member supporting each of said at least two clamping members from the outside thereof at a position diametrically opposed to that of said inner fulcrum member so as to permit the pivotal movement of said clamping members; a tapered member disposed within the space defined by said clamping guide sections of said at least two clamping members and having an outwardly tapered outer peripheral surface so that when said tapered member is drawn or pulled outwardly said tapered outer peripheral surface is forced to contact with the inner surfaces of said clamping guide sections to force said clamping guide sections to move away from each other while forcing said clamping jaw sections to pivot about said inner and outer fulcrum members to move toward each other, thereby the clamping force at said clamping jaw sections being increased as the drawing or pulling force applied to said tapered member is increased.

To clamp a bar- or rod-shaped member it is preferable to use more than three clamping members. The clamping device comprising a pair of clamping members is adapted to clamp a sheet- or plate-like member, but when the configurations of the jaw sections are suitably designed a member of any shape may be firmly clamped in position. When more than three clamping members are used, it is preferable that an inner pivot member comprises a ball-shaped member, but when a pair of clamping members are used, a rod-shaped pivot member may be used instead of a ball-shaped pivot member. The retaining or outer pivot member is preferably a ring-shaped member regardless of the fact that a pair of clamping members or more than three clamping members are used.

In order that the clamping device in accordance with the present invention may withstand the excessive drawing or pulling force, each of the guide sections of the clamping members has a first ridge extending radially inwardly from the outer end thereof and normally made into forced contact with the tapered outer surface of the tapered member. Furthermore the tapered member may have an annular ridge extending radially inwardly from rear or inner end thereof for engagement with a second ridge formed on each of the clamping guide sections which also extends radially inwardly and is spaced apart from the first ridge inwardly thereof when the tapered member is displaced outwardly in excess of a predetermined distance, whereby the displacement of the tapered member with respect to the clamping members may be prevented.

According to one aspect of the present invention the clamping device may be combined with an impact applying device adapted to exert the impact to the tapered member so as to force it to displace itself outwardly. The impact applying device comprises a guide rod whose one end is coupled to the tapered member through suitable connecting means and whose the other end is securely fixed to a stop member, and a block of a relatively large mass. The block is caused to slide over the guide rod and strike the stop member at a high speed so that the tapered member is pulled outwardly by the impact transmitted through the stop member and the guide rod.

Opposed to the prior art clamping device, the clamping device in accordance with the present invention eliminates the clamping bolt, and has at least two clamping members each supported by a ball or balls or a rod so as to pivot thereabout, the clamping members being held together by a retaining ring. Within the space defined inwardly by the guide sections of the clamping members is disposed the tapered member whose tapered outer surface is made into contact with the mating tapered inner surface of the guide sections or the radially inwardly extending ridges thereof. Therefore, a metal plate, rod and the like may be clamped or released by the so-called one-touch action. Furthermore the danger of tearing of the head of the clamping bolt is eliminated; the service life of the clamping device may be increased considerably, and the clamping force may be increased as the drawing or pulling force exerted to the clamping device is increased. Moreover the clamping device in accordance with the present invention is simple in construction and inexpensive to manufacture. Since the clamping bolt is not used, the axial length of the space may be enlarged, within which space the member to be clamped may be received past the clamping jaws. Thus the clamping device in accordance with the present invention finds a wide application in various fields. For instance, it is not only used for straightening a bent or twisted automotive frame but also for clamping steel bars or rods or steel frames for loading and unloading.

The above and other objects, features and advantages of the present invention will become more apparent from the following description of some preferred embodiments thereof taken in conjunction with the accompanying drawing.

Figure 1:
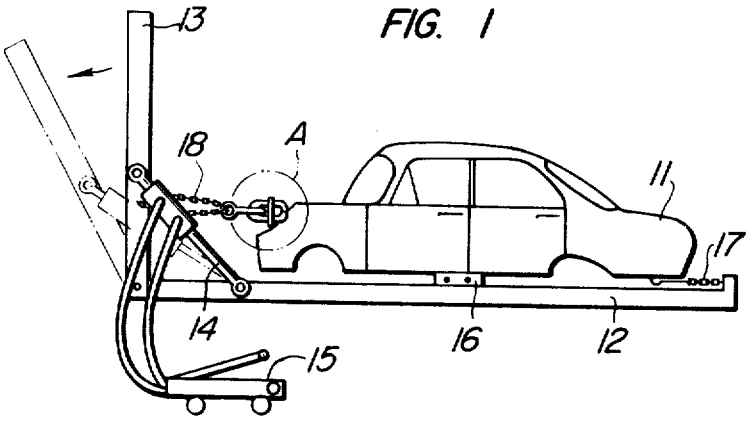
FIG. 1 is a schematic view of a body straightening device in which the clamping device in accordance with the present invention finds particular use.
Figure 2:
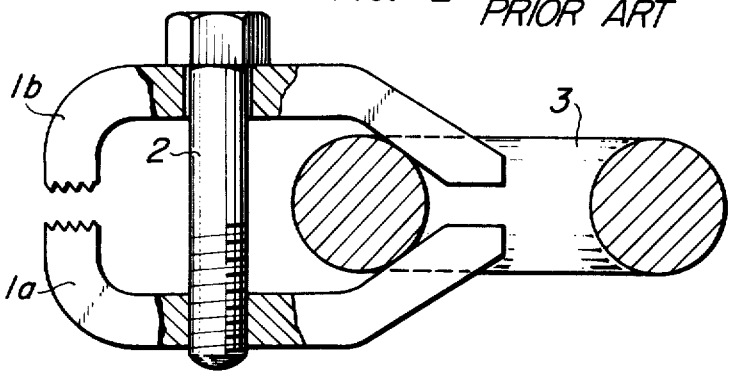
FIG. 2 PRIOR ART
FIGS. 2 and 3 are side views of one prior art clamping device.
Figure 3:
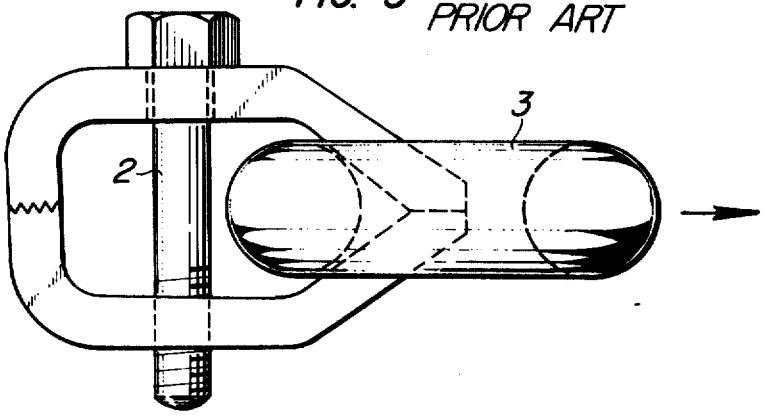
FIG. 3 PRIOR ART

Prior Art, FIGS. 1, 2, and 3

Prior to the description of the preferred embodiments of the present invention, the prior art clamping device will be described briefly as to its construction and mode of operation in order to point out specifically and distinctly its defects which the present invention contemplates to overcome.

FIG. 2 shows the prior art clamping device in its opened position while FIG. 3, in its closed position. The clamping device has a pair of clamping jaws 1a and 1b which are moved toward or away from each other by tightening or closing a clamping bolt 2. The clamping device of the type described is used, for instance, to straighten a bent, twisted or crushed automotive body frame as will be described hereinafter with reference to FIG. 1 showing an automotive body 11 whose front section is crashed by an accident. The body 11 is supported on and firmly held to a support 12 by suitable retaining means 16 and 17. A body straightening device 13 has its lower end pivoted to the front end of the support 12 and is normally held in the upright inoperative position indicated by the solid lines. In operation an oil pump 15 is energized to force the working oil under pressure into a hydraulic jack 14 connecting the support 12 with the body straightening device 13 so that the latter is forced to swing to the position indicated by the dotted lines in FIG. 1. The clamping device shown as being located within a circle A in FIG. 1 has its pair of clamping jaws 1a and 1b firmly clamping therebetween the frame of the body 11 as the clamping bolt 2 is tightened. The clamping device is coupled thorough a ring 3 (See FIGS. 2 and 3) and a chain 18 to the body straightening device 13. Thus, when the oil pump 15 is energized, the twisted or bent body frame is straightened up. In operation, the clamping device has its pair of clamping jaws 1a and 1b firmly closed, clamping the frame therebetween as shown in FIG. 3, and when the ring 3 is pulled in the direction indicated by the arrow the inwardly bent or converged portions of the clamping jaws 1a and 1b are forced to move toward each other, whereby the clamping force may be increased.

Figure 4:
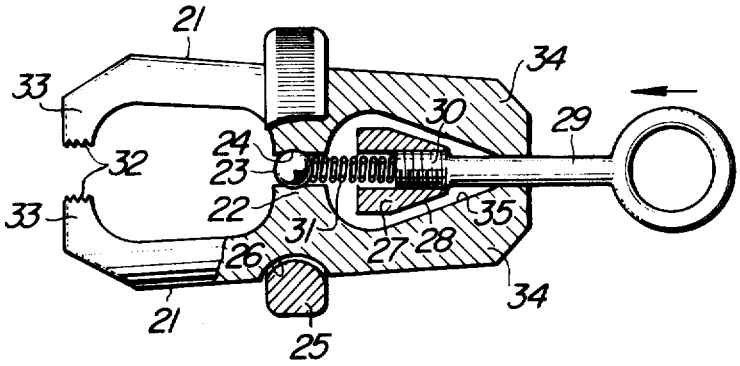
FIGS. 4 and 5 are side views of a first embodiment of the present invention.
Figure 5:
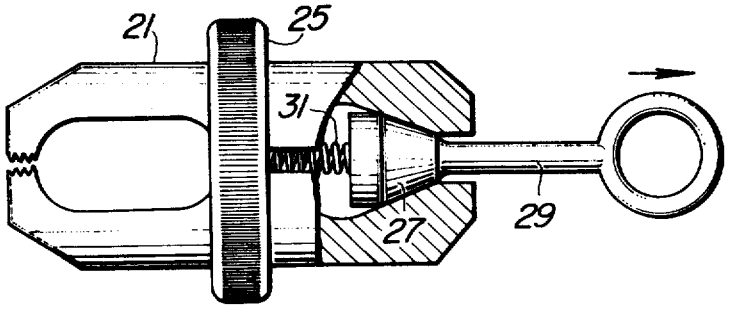

First Embodiment, FIGS. 4 and 5

Referring to FIGS. 4 and 5, the first embodiment of a clamping device in accordance with the present invention comprises a pair of clamping members 21 each of which has a jaw section 33 at one end thereof and a clamping guide section 34 at the other end thereof. Each of the clamping members is provided with a radially inwardly extending ridge the top of which has a groove substantially semicircular in cross section for fitting therein a ball or inner fulcrum member 23. A knurled retaining ring or outer fulcrum member 25 is fitted into grooves 26 formed in the outer surfaces of the clamping members in diametrically opposed relation with the grooves 24. Within the space defined by the pair of clamping guide sections 34 is disposed a tapered member 27 which has an outwardly tapered outer peripheral surface 28 and screwed to the externally threaded screws 30 of an eye-bolt-shaped drawbar 29. A coiled spring 31 loaded between the free end of the drawbar 29 and the ball 23 is normally compressed. Therefore, under the normal condition the tapered member 27 is biased outwardly, i.e. toward the right in FIG. 1 under the force of the spring 31 so that the tapered outer peripheral surface 28 of the member 27 is normally pressed against the tapered inner surfaces 35 of the guide sections 34 as shown in FIG. 5. Consequently, the pair of the clamping members 21 or clamping jaw sections 33 are closed. The pair of the clamping members 21 are held together by the ring or outer fulcrum member 25, and are adapted to pivot about the ball or inner fulcrum member 23.

To open the clamping device, the drawbar 29 is pushed in the direction indicated by the arrow in FIG. 4 while gripping the tapered guide section 34. Thereafter, a frame to be clamped is inserted between the pair of opened jaw sections 33 whose clamping surfaces 32 are toothed in order to ensure the firm gripping, and then the force applied to the drawbar 29 is released. Then the tapered member 27 is returned to the normal position shown in FIG. 5 under the force of the spring 31 so that the frame may be securely held by the clamping jaw sections 33. When the drawbar 29 coupled to the body straightening device of the type shown in FIG. 1 is pulled, the tapered member 27 is forced to be pressed against the tapered inner surfaces 35 of the tapered guide sections 34 of the clamping device so that the clamping force may be considerably multiplied or increased. Thus the first embodiment of the present invention has the very critical feature that the stronger the drawing force, the stronger the clamping force becomes. After the body straightening operation, the clamping device may be easily opened when the drawbar 29 is pushed in the direction indicated by the arrow in FIG. 4.

Figure 6:
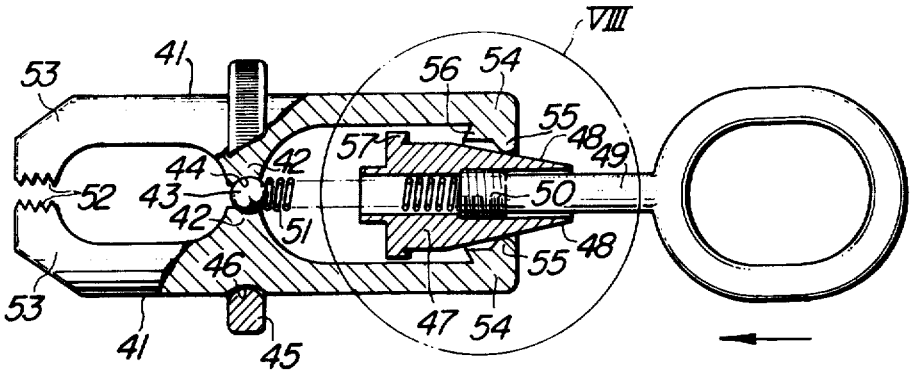
FIGS. 6 and 7 are side views of a second embodiment of the present invention.
Figure 7:
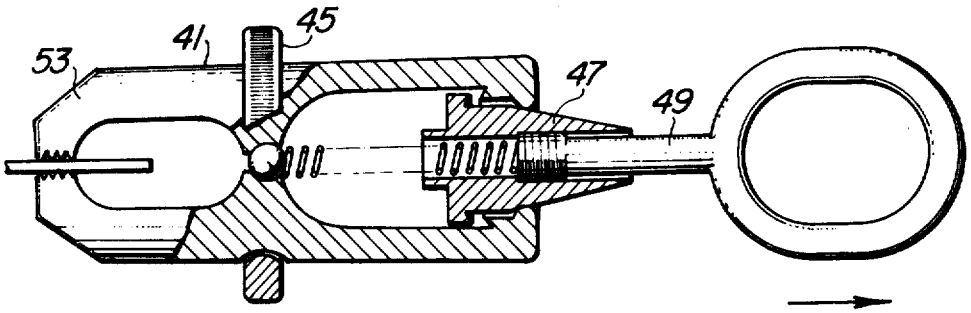

Second Embodiment, FIGS. 6 and 7

The second embodiment of the present invention to be described hereinafter with reference to FIGS. 6 and 7 is substantially similar in construction to the first embodiment described hereinbefore with reference to FIGS. 4 and 5 except a few arrangements to be described in detail hereinafter. The clamping device comprises a pair of clamping members 41 each of which has a clamping jaw section 53 at one end thereof and a clamping guide section 54 at the other end thereof. Each of the clamping jaw sections 53 has radially internally extending ridge 42 the top of which has a groove 44 substantially semi-circular in cross section for fitting therein a ball 43 or inner fulcrum member. A retaining ring or outer fulcrum member 45 is fitted into the annular grooves 46 formed in the outer surfaces of the clamping members 41 substantially in diametrically opposed relation with the grooves 44. Within the space defined by the pair of guide sections 54 is disposed a tapered member 47 which has a tapered outer surface 48 and which is screwed to the externally threaded screw portion 50 of an eye-bolt-shaped drawbar 49. A coiled spring 51 loaded between the free end of the drawbar 49 and the ball 43 is normally compressed so that the ball 43 may be securely held in a predetermined position while the tapered member 47 is normally biased outwardly, i.e. to the right in FIG. 7.

The clamping jaw sections 53 of the clamping members 41 have the toothed clamping surfaces 52. The pair of guide sections 54 of the clamping members 41 have semi-annular ridges 55 which are made into contact with the tapered outer surface 48 of the tapered member 47 so that when the latter is drawn outwardly, i.e. to the right in FIG. 7, the semi-annular ridges 55 are moved away from each other. The guide sections 54 also have semi-annular ridges 56 formed inwardly of the outer semi-annular ridges 55 and substantially wedge-shaped in cross section so that an annular ridge 57 substantially wedge-shaped in cross section of the tapered member 47 may engage with the inner wedge-shaped semi-annular ridges 56 of the guide sections 54 when the member 47 is drawn to the right, whereby the further displacement of the member 47 may be prevented.

Under the normal conditions, the tapered member 47 forces the outer ridges 55 of the guide sections 54 of the clamping members 41 to move away from each other under the force of the spring 51 so that the pair of clamping jaw sections 53 are forced to be closed. The pair of clamping members 41 are held together by the ring or outer fulcrum member 45 and are adapted to swing about the ball or inner fulcrum member 43. To clamp a body frame or the like, the drawbar 49 is pushed inwardly in the direction indicated by the arrow in FIG. 6 while the guide sections 54 are firmly gripped. Thereafter the body frame or the like is inserted between the toothed clamping surfaces 52 of the clamping jaws 53, and the gripping force applied to the drawbar 49 is released. Then, the clamping device is automatically closed under the force of the spring 51 as shown in FIG. 7, clamping firmly the body frame or the like. When the drawbar 49 coupled to the body straightening device of the type shown in FIG. 1 is pulled or drawn in the direction indicated by the arrow in FIG. 7, the tapered member 47 forces the outer ridges 55 and hence the guide sections 54 to move away from each other while forcing the jaw sections 53 to move toward each other, thus increasing the clamping force. The second embodiment of the present invention has also the critical feature that the stronger the drawing force, the stronger the clamping force becomes.

The clamping device of the second embodiment is so designed that when the drawing force exerted to the drawbar 49 is less than a predetermined magnitude (for instance, two tons), the straightening or alignment operation may be finished before the annular ridge 57 of the tapered member 47 engages with the mating inner ridges 46 of the guide sections 54 of the clamping members 41. In other words, the drawing or pulling force may be transmitted only through the forced contact between the outer ridges 55 of the guide sections 54 of the clamping members 41 and the tapered outer surface 48 of the tapered member 47. However, when the drawing force is in excess of a predetermined value, the tapered member 47 would be pulled out of the guide sections 54, but in accordance with the present invention the annular wedge-shaped ridge 57 of the tapered member 47 engages with the mating inner wedge-shaped ridges 56 of the guide sections 54 when the former is pulled to the extreme right so that the member 47 may be prevented from being pulled out of the guide sections 54 and the drawing force may be transmitted through the engagement between the wedge-shaped ridges 57 and 56. However, it should be noted that the clampingforce cannot be increased any more once the wedge-shaped ridges 56 and 57 engage with each other, but the sufficiently strong clamping force is exerted to the body frame or the like with the toothed clamping surfaces 52 of the jaw sections 53 firmly catching the body frame or the like. Therefore, there is no fear that the body frame or the like is pulled out of the clamping device. The magnitude of the drawing force at which the wedge-shaped ridges 56 and 57 engage with each other, must be determined depending upon the dimensions, materials, clamping conditions, and so on of the clamping member 41, and it is imperative to provide the wedge-shaped ridges 56 and 57 so as to prevent the pulling out of the tapered member 47 out of the guide sections 54 so that the clamping device may satisfactorily withstand a strong drawing force. When it is desired to open the clamping device, the drawbar 49 is pushed inwardly in the direction indicated by the arrow in FIG. 6.

Figure 8:
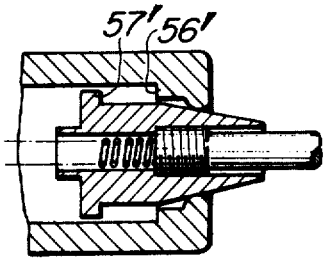
FIG. 8 is a fragmentary sectional view of a modification of the second embodiment shown in FIGS. 6 and 7.

Modification of the Second Embodiment, FIG. 8

One modification of the second embodiment will be described with reference to FIG. 8. In the second embodiment, the annular wedge-shaped ridge 57 of the tapered member 47 engages with the mating wedge-shaped ridges 56 of the guide sections 54 of the clamping members 41 so that the member 47 may be prevented from being pulled out of the guide sections 54 even when the strong drawing force is exerted, but in the modification of the second embodiment, an annular flange 57' having a rectangular cross sectional configuration is formed around the bottom (the left end) of the cylindrical section of the tapered member 47 while semi-annular vertically stepped portions 56' is formed inwardly of the outer ridges 55 of the guide sections 54. Therefore, when the drawing force is in excess of a predetermined magnitude, the flange 57' engages with the vertically stepped portions 56' so that the member 47 may be prevented from being pulled out of the guide sections 54. This modification has an advantage over the second embodiment in that the fabrication or machining is simple as the wedge-shaped ridges are not formed.

In the first and second embodiments and the modification of the second embodiment described hereinbefore with reference to FIG. 4 through FIG. 8, only one ball 23 or 43 has been used, but, if necessary, a plurality of balls may be juxtaposed. In the above embodiments and modification, the fulcrum of the pair of clamping members 21 or 41 is slightly displaced toward the jaw sections 33 or 53 from the midpoint of the clamping device in order to increase the clamping force, but it is to be understood that the fulcrum may be suitably selected as needs demand. For instance, if it is desired to increase, the axial length of the space within which the member to be clamped may be received past the clamping jaws, the pivot point may be displaced toward the guide sections from the midpoint, and if it is desired to provide a more stronger clamping force, the fulcrum may be further displaced toward the clamping jaws. It is preferable that the clamping surfaces 33 or 53 of the clamping jaws 21 or 41 be rugged, but if needs demand, they may be flat.

Assembly of the Clamping Devices

In assembly, the tapered member 27 or 47 is disposed within the space defined by the guide sections of the clamping members 21 or 41 with the ball 23 or 43 removed, and thereafter the ring 25 or 45 is fitted over the jaw sections of the clamping members 21 or 41, displaced toward the right and finally fitted into the grooves 26 or 46, which define a continuous annular groove. Next the ball 23 or 43 and the coiled spring 31 or 51 are fitted into the outer hole of the tapered member 27 or 47 in the order named, and then the ball 23 or 43 is forced to be fitted into the grooves 24 or 44 of the clamping members 21 or 41. Thereafter, the drawbar 29 or 49 is screwed to the tapered member 27 or 47. Thus, the clamping device is assembled.

Figure 9:
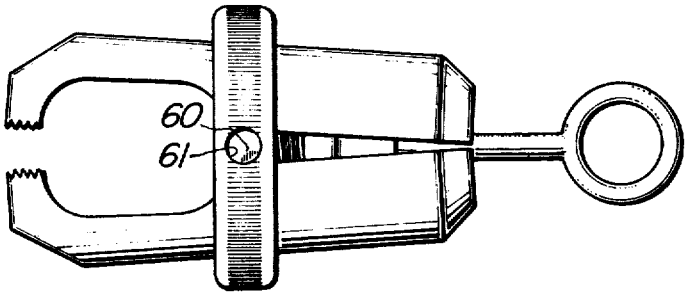
FIGS. 9 and 10 are views illustrating a modification of the first embodiment shown in FIGS. 4 and 5.
Figure 10:
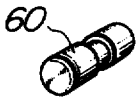

Modification of the First Embodiment, FIGS. 9 and 10

The modification of the first embodiment shown in FIGS. 9 and 10, is substantially similar in construction to the first embodiment except that instead of the ball 23, a pivot rod 60 is used. In assembly, the pivot rod 60 is inserted through a hole 61 formed through the ring 25 and fitted into the pivot rod receiving grooves formed in the pair of clamping members 21 until the pivot rod 60 is completely inserted into the groove. Thereafter, the ring 25 is rotated through a suitable angle so that its inner surface prevents the pivot rod 60 from being pulled out of the groove.

The above-mentioned modification may be applied to the second embodiment of the present invention.

Figure 11:
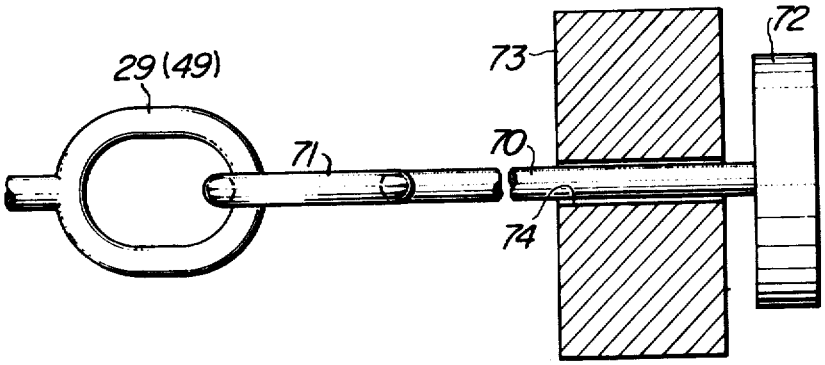
FIG. 11 is a schematic view of an impact or drawing force application device adapted for use with the clamping devices in accordance with the present invention.

Impact Application Device, FIG. 11

The impact application device shown in FIG. 11 comprises a connecting member 71 adapted to be coupled to the eye of the drawbar 29 or 49 of the clamping device of the present invention, a guide rod 70 whose one end is joined to the connecting member 71 and whose the other end is fixed to a stop member 72, and a block 73 which has a relatively large mass and has a thorough bore 74 whose diameter is slightly larger than the outer diameter of the guide rod 70 and through which the guide rod 70 extends. The block slides over the guide rod 70 at a high speed toward the stop 72, and strikes against it, thus producing the drawing force for drawing the drawbar and hence closing and drawing the clamping device. The impact application device of the type above which is very simple in construction is used, for instance, to straighten the body frame bent or twisted by an accident, thus preventing the free rotation of a wheel when a service station is too far so that only manual force is available for relieving this situation. The bent or twisted body frame may be straightened up only by the manual force when the above impact application device is used.

What is claimed is:

1. A clamping device comprising a. at least two clamping members each having a clamping jaw section at one end thereof and a clamping guide section at the other end thereof;

b. an inner fulcrum member positioned between and supporting said clamping members so as to enable said clamping members to pivot about said inner fulcrum member, said inner fulcrum member also being positioned between the ends of each of said clamping members;

c. an outer retaining ring surrounding and supporting said clamping member at positions diametrically opposed to that of said inner fulcrum member so as to pivotally retain said clamping members with respect to said inner fulcrum member;

d. a tapered member disposed within a space defined by and located between said clamping guide sections of said clamping members, said member having a tapered outer peripheral surface arranged such that when said tapered member is displaced to move said tapered outer peripheral surface into contact with inner surfaces of said clamping guide sections, said clamping guide sections are moved away from each other thereby forcing said clamping jaw sections to move toward each other by pivotal movement of said clamping members about said inner fulcrum member, the clamping force at said clamping jaw sections being increased as the displacement of said tapered member is increased.

2. A clamping device as defined in claim 1 wherein said inner surfaces of said clamping guide sections of the clamping members are tapered so as to mate with said tapered outer peripheral surface of said tapered members.

3. A clamping device as defined in claim 2 wherein said inner fulcrum member comprises a ball-shaped member.

4. A clamping device as defined in claim 1 wherein each of said clamping guide sections has a first semi-annular ridge extending radially inwardly from an outer end of the clamping guide section and normally contacting the tapered outer peripheral surface of said tapered member, and a second semi-annular ridge extending radially inwardly from said outer end and spaced axially inwardly from said first ridge; and wherein said tapered member has an annular ridge extending radially outwardly from one end thereof for engagement with said second ridges of said clamping guide sections when said tapered member is displaced by a force in excess of a predetermined magnitude, whereby further displacement of said tapered member with respect to said guide sections is prevented.

5. A clamping device as defined in claim 4, wherein said inner fulcrum member comprises a ball-shaped member.

6. A clamping device as defined in claim 5, further comprising a device for displacing said tapered member device comprising a guide rod coupled at one end to said tapered member and fixed to a stop member at its other end, and a block having a relatively large mass and slidably fitted over said guide rod.

7. A clamping device as defined in claim 4, wherein said inner fulcrum member comprises a rod-shaped member.

8. A clamping device as defined in claim 7 further comprising a device for displacing said tapered member device comprising a guide rod coupled at one end to said tapered member and fixed to a stop member at its other end, and a block having a relatively large mass and slidably fitted over said guide rod.

9. A clamping device as defined in claim 1 wherein said inner fulcrum member comprises a rod-shaped member.

10. A clamping device as defined in claim 1 further comprising a device for displacing said tapered member comprising a guide rod coupled at one end to said tapered member through coupling means and fixed to a stop member at its other end, and a block having a relatively large mass and slidably fitted over said guide rod.

* * * * *